US011773493B2

(12) United States Patent
Sato et al.

(10) Patent No.: US 11,773,493 B2
(45) Date of Patent: Oct. 3, 2023

(54) MATERIAL FOR COLD SPRAYING

(71) Applicant: NIPPON YTTRIUM CO., LTD., Omuta (JP)

(72) Inventors: Ryuichi Sato, Omuta (JP); Naoki Fukagawa, Omuta (JP); Kento Matsukura, Omuta (JP); Shuki Mikoda, Omuta (JP); Seiji Moriuchi, Omuta (JP); Yuji Shigeyoshi, Omuta (JP); Masahiro Fukumoto, Toyohashi (JP); Motohiro Yamada, Toyohashi (JP)

(73) Assignee: NIPPON YTTRIUM CO., LTD.

( * ) Notice: Subject to any disclaimer, the term of this patent is extended or adjusted under 35 U.S.C. 154(b) by 38 days.

(21) Appl. No.: 17/288,302

(22) PCT Filed: Oct. 18, 2019

(86) PCT No.: PCT/JP2019/041162

§ 371 (c)(1),
(2) Date: Apr. 23, 2021

(87) PCT Pub. No.: WO2020/090528

PCT Pub. Date: May 7, 2020

(65) Prior Publication Data

US 2022/0002879 A1 Jan. 6, 2022

(30) Foreign Application Priority Data

Oct. 31, 2018 (JP) ..... 2018-206022
Oct. 31, 2018 (JP) ..... 2018-206049

(51) Int. Cl.
*C23C 24/04* (2006.01)

(52) U.S. Cl.
CPC ..... *C23C 24/04* (2013.01)

(58) Field of Classification Search
None
See application file for complete search history.

(56) References Cited

U.S. PATENT DOCUMENTS

2008/0131612 A1* 6/2008 Hu ..... C23C 24/04 427/454
2010/0329954 A1 12/2010 Yokota et al.
(Continued)

FOREIGN PATENT DOCUMENTS

JP 2010-172817 A 8/2010
JP 2014-40634 A 3/2014
(Continued)

OTHER PUBLICATIONS

Kubrin, Roman, et al., "Flame aerosol deposition of Y2O3:Eu nanophosphor screens and their photoluminescent performance", Nanotechnology, May 7, 2010, vol. 21, No. 22, pp. 225603-1 to 225603-7 (9 pages).
(Continued)

*Primary Examiner* — Colin W. Slifka
(74) *Attorney, Agent, or Firm* — Harness, Dickey & Pierce, P.L.C.

(57) ABSTRACT

A material for cold spraying contains a powder of a compound of a rare earth element with a specific surface area of 30 $m^2/g$ or more as determined by a BET single-point method. The powder preferably has a volume of pores with a pore size of 3 to 20 nm of 0.08 $cm^3/g$ or more as determined by a gas absorption method. The powder also preferably has a crystallite diameter of 25 nm or less. The powder also preferably has a repose angle of from 10 to 60°. In the L*a*b* color system, the powder also preferably has a value L of 85 or more, a value a of from −0.7 to 0.7, and a value b of from −1 to 2.5.

18 Claims, 1 Drawing Sheet

(56) References Cited

U.S. PATENT DOCUMENTS

| | | | |
|---|---|---|---|
| 2011/0305605 | A1 | 12/2011 | Jaeger et al. |
| 2015/0307715 | A1 | 10/2015 | Sato et al. |
| 2017/0342539 | A1 | 11/2017 | Sato et al. |
| 2018/0362359 | A1 | 12/2018 | Sato et al. |
| 2019/0241746 | A1 | 8/2019 | Fukagawa et al. |

FOREIGN PATENT DOCUMENTS

| | | | |
|---|---|---|---|
| JP | 2016-138309 | A | 8/2016 |
| WO | 2015-019673 | A1 | 2/2015 |
| WO | 2016-129457 | A1 | 8/2016 |
| WO | 2017-115662 | A1 | 7/2017 |
| WO | 2018-083854 | A1 | 5/2018 |

OTHER PUBLICATIONS

Tarui, Hiroyasu, et al., "Cold Spraying Technology for Ceramics", Journal of the Japan Welding Society, vol. 87 (2018) No. 2, pp. 114-119, with partial translation(13 pages).

International Search Report (English and Japanese) of the International Searching Authority issued in PCT/JP2019/041162, dated Jan. 7, 2020; ISA/JP (5 pages).

Han Changri et al. "Manufacturing technology of fine inorganic chemicals"; published by Beijing Science and Technology Literature Press; published in Aug. 2008 (total 5 pages).

* cited by examiner

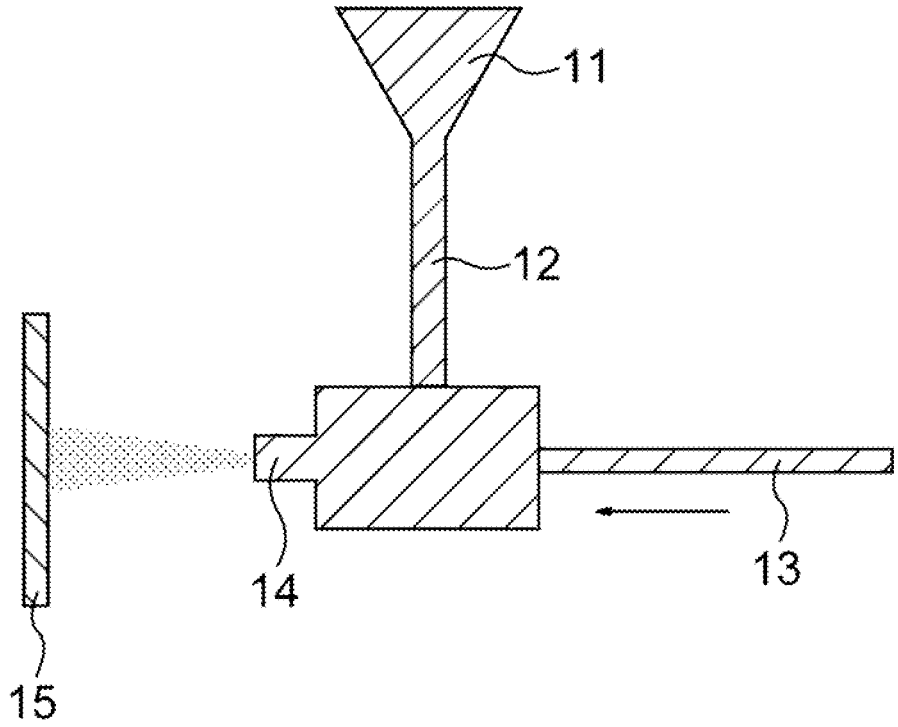
11
12
13
14
15

MATERIAL FOR COLD SPRAYING

CROSS REFERENCE TO RELATED APPLICATIONS

This application is a U.S. National Phase Application under 35 U.S.C. 371 of International Application No. PCT/JP2019/041162, filed on Oct. 18, 2019, which claims priority to Japanese Patent Application No. 2018-206049, filed on Oct. 31, 2018 and Japanese Patent Application No. 2018-206022, filed on Oct. 31, 2018. The entire disclosures of the above applications are expressly incorporated by reference herein.

BACKGROUND

Technical Field

The present invention relates to a material for cold spraying, a method for producing a coating using a cold spraying method, a cold sprayed coating, a method for producing a powder of a rare earth element oxide, a method for producing an unfired powder of a rare earth element fluoride, and a method for producing a powder of a rare earth element oxyfluoride.

Related Art

Cold spraying methods are systems for producing a coating by accelerating particles as a raw material to a speed close to a sonic speed and causing the particles kept in a solid phase to collide against a substrate.

Cold spraying methods are coating techniques classified as a type of thermal spraying methods, but are different from ordinary thermal spraying methods in the following: a raw material is caused to adhere to a substrate without being melted in cold spraying methods, whereas a raw material in a melted state or a half-melted state is caused to collide against a substrate to form a coating in ordinary thermal spraying methods.

Conventionally, cold spraying methods are typically employed to form a coating of metal with excellent ductility, and there are very few instances in which they are employed to form a coating of ceramic, which is a brittle material.

However, recently, an instance has been reported in which a coating was formed from a $TiO_2$ nano-agglomerated powder with a high specific surface area using a cold spraying method (TARUI Hiroyasu, et al. "Cold Spraying Technology for Ceramics", Journal of the Japan Welding Society, Vol. 87 (2018) No. 2, p 114-119).

Meanwhile, a compound containing a rare earth element has high corrosion resistance to halogen-based gas. Halogen-based gas is used in etching treatment in production of semiconductor devices, and accordingly, a coating of a compound containing a rare earth element is effective to prevent corrosion of plasma etching apparatuses. Conventionally, a coating of a corrosion-resistant rare earth compound on plasma etching apparatuses is obtained by forming a coating from a powder of a compound containing a rare earth element through plasma thermal spraying or the like (JP 2014-40634A, for example).

In coating through plasma thermal spraying, a coating material is dissolved by a high temperature gas state, accelerated in a plasma jet, and caused to collide against a substrate, to form a coating. Thus, when a powder of a compound of a rare earth element is subjected to plasma thermal spraying, the powder is altered during the thermal spraying, and thus coatings having various desirable physical properties including color are unlikely to be obtained unfortunately. On the other hand, the cold spraying method are expected to prevent physical properties of a coating material from being altered during thermal spraying, because the raw material is caused to adhere to a substrate without being melted in this method. However, when a conventional rare earth compound powder for plasma thermal spraying described in JP 2014-40634A is used as is as a material for cold spraying, the coating efficiency is low, and a coating with a sufficient thickness cannot be formed.

Furthermore, a $TiO_2$ powder as described in "Cold Spraying Technology for Ceramics" does not have corrosion resistance to halogen-based gas, and the inventors of the present invention have found that, when a $TiO_2$ powder is used to form a coating using a cold spraying method, the coating obtained is yellower, and that it is thus difficult to obtain a coating with a desired color.

It is an object of the present invention to provide a material for cold spraying using a compound of a rare earth element with excellent corrosion resistance to halogen-based plasma, the material having excellent coat-forming properties and being capable of providing a coating with physical properties that are less changed from those of the raw material.

It is another object of the present invention to produce a coating with physical properties that are less changed from those of the raw material using, as a raw material, a powder of a compound of a rare earth element with excellent corrosion resistance to halogen-based plasma, and to provide a cold sprayed coating made of a compound of a rare earth element with excellent corrosion resistance to halogen-based plasma and having excellent physical properties including a degree of whiteness.

It is yet another object of the present invention to provide a method for producing a powder of a rare earth element oxide suitable for a cold spraying method, a method for producing an unfired powder of a rare earth element fluoride, and a method for producing a powder of a rare earth element oxyfluoride.

SUMMARY

The present invention provides a material for cold spraying, comprising a powder of a compound of a rare earth element with a specific surface area of 30 $m^2/g$ or more as determined by a BET single-point method.

Furthermore, the present invention provides a method for producing a coating, the method including subjecting a powder of a compound of a rare earth element with a specific surface area of 30 $m^2/g$ or more as determined by a BET single-point method to a cold spraying method.

Moreover, the present invention provides a coating produced by cold spraying a powder of a compound of a rare earth element with a BET specific surface area of 30 $m^2/g$ or more.

The powder preferably has a volume of pores with a pore size of 3 to 20 nm of 0.08 $cm^3/g$ or more as determined by a gas absorption method.

The powder preferably has a volume of pores with a pore size of 20 nm or less of 0.03 $cm^3/g$ or more as determined by a mercury intrusion porosimetry.

The powder preferably has a crystallite diameter of 25 nm or less.

The powder preferably has a repose angle of from 10 to 60°.

The powder preferably has a value L of 85 or more, a value a of from −0.7 to 0.7, and a value b of from −1 to 2.5 in an L*a*b* color system.

The rare earth compound is preferably at least one selected from the group consisting of an oxide of a rare earth compound, a fluoride of a rare earth compound, and an oxyfluoride of a rare earth compound.

The rare earth element is preferably yttrium.

According to another aspect, the present invention provides a cold sprayed coating made of a compound of a rare earth element, and the coating is preferably made of a rare earth element oxide, a rare earth element fluoride, or a rare earth element oxyfluoride.

The coating preferably has a value L of 85 or more, a value a of from −0.7 to 0.7, and a value b of from −1 to 2.5 in the L*a*b* color system.

The coating preferably has a crystallite diameter of from 3 to 25 nm.

According to still another aspect, the present invention provides a method for producing a powder of a rare earth element oxide, including: dissolving a powder of a rare earth element oxide in a warmed weakly acidic aqueous solution and then cooling down the resulting solution to thereby allow a weak acid salt of the rare earth element to precipitate; and firing the weak acid salt at 450 to 950° C.

The present invention also provides a method for producing an unfired powder of a rare earth element fluoride, including: mixing an aqueous solution of a water-soluble salt of a rare earth element with hydrofluoric acid to thereby allow a rare earth element fluoride to deposit; and drying the obtained deposit at 250° C. or less.

The present invention also provides a method for producing a powder of a rare earth element oxyfluoride, including: mixing, with hydrofluoric acid, a powder of a rare earth element oxide or a precursor that forms a rare earth element oxide when being fired, to thereby obtain a precursor of a rare earth element oxyfluoride; and firing the obtained precursor of the rare earth element oxyfluoride.

Advantageous Effects of the Invention

The present invention can provide a material for cold spraying, the material containing a powder of a compound of a rare earth element with excellent corrosion resistance to halogen-based plasma. The material has excellent coat-forming properties in a cold spraying method, and is capable of providing a coating with physical properties that are similar to those of the raw material powder. When the material for cold spraying of the present invention is used to form a coating using a cold spraying method, it is possible to obtain a coating that is less yellowish and has a color that is similar to the color of the raw material powder, which is difficult to obtain when a $TiO_2$ powder is used.

The present invention can also provide a method for producing a coating using, as a raw material, a powder of a compound of a rare earth element with excellent corrosion resistance to halogen-based plasma, the coating having physical properties that are less changed from those of the raw material, and the present invention can also provide a cold sprayed coating made of a compound of a rare earth element with excellent corrosion resistance to halogen-based plasma and having an excellent degree of whiteness.

Furthermore, according to the method for producing a powder of a rare earth element oxide, the method for producing a powder of a rare earth element fluoride, and the method for producing a powder of a rare earth element oxyfluoride of the present invention, which are industrially advantageous methods, it is possible to produce a material for cold spraying of the present invention.

BRIEF DESCRIPTION OF THE DRAWINGS

The FIGURE is a schematic diagram illustrating a powder feeding method when forming a coating in Examples.

DETAILED DESCRIPTION

Hereinafter, the present invention will be described based on preferred embodiments thereof.

1. Powder of Compound of Rare Earth Element and Material for Cold Spraying Containing the Same Hereinafter, first, a powder of a compound of a rare earth element, and a material for cold spraying containing the same will be described. Hereinafter, "cold spraying" may be abbreviated as "CS".

(1) Compound of Rare Earth Element

One of the characteristics of the CS material of the present invention is that it comprises a powder of a compound of a rare earth element (hereinafter, the rare earth element may be referred to as "Ln", and the compound of a rare earth element may be referred to simply as "rare earth compound"). All of preference described for the CS material hereinbelow also apply to a rare earth compound powder contained in the CS material. For example, all values of the preferable BET specific surface area described below for the CS material are also preferable for the rare earth compound powder.

Examples of a rare earth (Ln) element include 16 kinds of elements, specifically, scandium (Sc), yttrium (Y), lanthanum (La), cerium (Ce), praseodymium (Pr), neodymium (Nd), samarium (Sm), europium (Eu), gadolinium (Gd), terbium (Tb), dysprosium (Dy), holmium (Ho), erbium (Er), thulium (Tm), ytterbium (Yb), and lutetium (Lu). The CS material of the present invention contains at least one of the 16 types of rare earth elements. Of these elements, the rare earth (Ln) element is preferably at least one selected from yttrium (Y), cerium (Ce), samarium (Sm), gadolinium (Gd), dysprosium (Dy), erbium (Er), and ytterbium (Yb), and more preferably yttrium (Y), in view of further improving the thermal resistance, the wear resistance, the corrosion resistance, etc., of a coating obtained by the CS method.

The rare earth compound in the present invention is preferably a rare earth element (Ln) oxide, a rare earth element fluoride, or a rare earth element oxyfluoride.

The oxide of a rare earth element except for praseodymium (Pr) or terbium (Tb) is a sesquioxide ($Ln_2O_3$; Ln is a rare earth element). The praseodymium oxide is typically $Pr_6O_{11}$, and the terbium oxide is typically $Tb_4O_7$. The rare earth element oxide may be a complex oxide of two or more rare earth elements.

The rare earth element fluoride is preferably represented by $LnF_3$.

The rare earth element oxyfluoride is a compound composed of rare earth (Ln) element, oxygen (O), and fluorine (F). The rare earth element oxyfluoride may be a compound (LnOF) with a molar ratio between rare earth (Ln) element, oxygen (O), and fluorine (F), Ln:O:F, of 1:1:1, or may be a rare earth element oxyfluoride in another form ($Ln_5O_4F_7$, $Ln_7O_6F_9$, $Ln_4O_3F_6$, etc.). It is preferable that the rare earth element oxyfluoride should be represented by $LnO_xF_y$ ($0.3 \leq x \leq 1.7$, $0.1 \leq y \leq 1.9$), in view of high productivity of the oxyfluoride and more reliably exhibiting the effects of the present invention including a dense and uniform structure with a high corrosion resistance. In the above formula, it is more preferable that $0.35 \leq x \leq 1.65$, and even more preferable that $0.4 \leq x \leq 1.6$, particularly from the above-described viewpoints. Also, it is more preferable that $0.2 \leq y \leq 1.8$, and even more preferable that $0.5 \leq y \leq 1.5$. Furthermore, in the above formula, x and y preferably satisfy $2.3 \leq 2x+y \leq 5.3$, more preferably satisfy $2.35 \leq 2x+y \leq 5.1$ and even more preferably satisfy $2x+y=3$.

The CS material of the present invention is preferably such that in X-ray diffractometry on the CS material using Cu-Kα rays or Cu-$K\alpha_1$ rays, the maximum intensity peak exhibited at 2θ=10 to 90° is assigned to a rare earth compound. For example, in X-ray diffractometry in the scanning range 2θ=10 to 90° using Cu-Kα rays or Cu-$K\alpha_1$ rays, the maximum intensity peak of yttrium oxide is exhibited typically at 20.1 to 21.0°, and the maximum intensity peak of yttrium fluoride is exhibited typically at 27.0 to 28.0°. Out of yttrium oxyfluorides, the maximum intensity peak of YOF is exhibited typically at 28.0 to 29.0°, and the maximum intensity peak of $Y_5O_4F_7$ is exhibited typically at 28.0 to 29.0°. Hereinafter, the maximum intensity peak exhibited at 2θ=10 to 90° is also referred to as a main peak.

More preferably, in the case in which the CS material of the present invention exhibits a main peak assigned to a rare earth compound at 2θ=10 to 90° in X-ray diffractometry, the height of a maximum intensity peak assigned to a component other than the compound of the rare earth element is preferably 10% or less, more preferably 5% or less, based on the height of the main peak, and it is even more preferable that no peak assigned to a component other than the compound of the rare earth element should be exhibited, in view of further improving the thermal resistance, the wear resistance, the corrosion resistance, etc., of a coating to be obtained. In particular, in the case in which the main peak exhibited at 2θ=10 to 90° in X-ray diffractometry is assigned to a rare earth element oxide, a rare earth element fluoride, or a rare earth element oxyfluoride, the height of a maximum intensity peak assigned to a component other than the rare earth element oxide, rare earth element fluoride, or rare earth element oxyfluoride is preferably 10% or less, more preferably 5% or less, based on the height of the main peak, and it is even more preferable that no peak assigned to a component other than the rare earth element oxide, rare earth element fluoride, or rare earth element oxyfluoride should be exhibited.

Moreover, in the case in which the CS material of the present invention exhibits a main peak assigned to a rare earth element oxide at 2θ=10 to 90° in X-ray diffractometry, the height of a maximum intensity peak assigned to a component other than the rare earth element oxide may be 10% or less, or 5% or less, based on the height of the main peak.

In the case in which the CS material of the present invention exhibits a main peak assigned to a rare earth element fluoride at 2θ=10 to 90° in X-ray diffractometry, the height of a maximum intensity peak assigned to a component other than the rare earth element fluoride may be 10% or less, or 5% or less, based on the height of the main peak.

In the case in which the CS material of the present invention exhibits a main peak assigned to a rare earth element oxyfluoride at 2θ=10 to 90° in X-ray diffractometry, the height of a maximum intensity peak assigned to a component other than the rare earth element oxyfluoride may be 10% or less, or 5% or less, based on the height of the main peak.

The above-described features in X-ray diffractometry may be satisfied in either X-ray diffractometry using Cu-Kα rays or that using Cu-$K\alpha_1$ rays, and it is not necessarily meant that these features are satisfied in both of X-ray diffractometry using Cu-Kα rays and that using Cu-$K\alpha_1$ rays.

(2) Specific Surface Area as Determined by BET Single-Point Method

When the rare earth compound powder having a specific surface area of 30 $m^2/g$ or more as determined by a BET single-point method is used for producing a coating by the CS method, a coating with a thickness greater than or equal to a certain thickness can be obtained. When a rare earth compound powder with such a high specific surface area is used in plasma thermal spraying, the material particles stall or evaporate before reaching a substrate, and thus it is difficult to form a coating. The specific surface area, as determined by the BET single-point method, of the rare earth compound powder is preferably 35 $m^2/g$ or more, more preferably 40 $m^2/g$ or more, even more preferably 45 $m^2/g$ or more, even more preferably 48 $m^2/g$ or more, and even more preferably 50 $m^2/g$ or more, in view of more stable coat-forming properties. The specific surface area as determined by the BET single-point method is preferably 350 $m^2/g$ or less, more preferably 325 $m^2/g$ or less, even more preferably 300 $m^2/g$ or less, and even more preferably 200 $m^2/g$ or less, in view of allowing rare earth compound particles to easily reach a substrate to thereby easily form a coating, and also easily flattening the particles when the particles collide against a substrate.

The specific surface area as determined by the BET single-point method can be specifically obtained using a method described in Examples later.

A rare earth compound powder having a specific surface area within the above-described range as determined by the BET single-point method can be produced using a later-described preferable method for producing a rare earth compound powder.

(3) Crystallite Diameter of CS Material

The rare earth compound powder for use in the CS material of the present invention preferably has a crystallite diameter less than or equal to a certain diameter, in view of stably obtaining a thick coating using the CS method and easily flattening particles when the particles collide against a substrate. From this viewpoint, the crystallite diameter of the rare earth compound powder is preferably 25 nm or less, more preferably 23 nm or less, and even more preferably 20 nm or less. The crystallite diameter is preferably 1 nm or more, and more preferably 3 nm or more, in view of easily producing the CS material and securing the strength of a CS coating to be obtained.

The crystallite diameter of a CS material can be measured through powder X-ray diffractometry, and specifically obtained using a method described in Examples later.

A rare earth compound powder having a crystallite diameter within the above-described range can be produced using a later-described preferable method for producing a rare earth compound powder.

(4) Volume of Pores with Pore Size of 3 to 20 nm as Determined by Gas Absorption Method The inventors of the present invention have found that a thick coating can be more easily produced when the rare earth compound powder having a volume of pores with a pore size of 3 to 20 nm of 0.08 $cm^3/g$ or more as determined by a gas absorption method is used for producing a coating by the CS method.

The reason for this is not clear, but is probably that the volume of pores between rare earth compound particles and pores inside the particles at a certain level or more improves the efficiency in adhering the particles to a substrate when the particles are pressed against the substrate with high speed gas.

The volume of pores with a pore size of 3 to 20 nm as determined by the gas absorption method is obtained in the following manner: an adsorption/desorption curve obtained by the gas absorption method is analyzed using a Dollimore-Heal method, and a cumulative value of pore volumes determined in the pore size range from 3 nm to 20 nm in the adsorption process and the desorption process is taken as the volume of pores. The volume of pores with a pore size of 3 to 20 nm is a parameter that depends not only on the crystallite diameter but also on the particle shape or the form of the particle aggregate, and thus it cannot be assured that volumes of pores with a pore size of 3 to 20 nm are the same even when the BET specific surface areas or the crystallite diameters are the same.

In the CS material of the present invention, the volume of pores with a pore size of 3 to 20 nm as determined by the gas absorption method is preferably 0.08 $cm^3/g$ or more, more preferably 0.1 $cm^3/g$ or more, and even more preferably 0.15 $cm^3/g$ or more.

In the CS material, the volume of pores with a pore size of 3 to 20 nm as determined by the gas absorption method is preferably 1.0 $cm^3/g$ or less, more preferably 0.8 $cm^3/g$ or less, even more preferably 0.6 $cm^3/g$ or less, and even more preferably 0.5 $cm^3/g$ or less, in view of easily producing the CS material and securing the flowability of the material.

The pore volume as determined by the gas absorption method can be specifically obtained using a method described in Examples below.

A rare earth compound powder having a volume of pores with a pore size of 3 to 20 nm within the above-described range as determined by the gas absorption method can be produced using a later-described preferable method for producing a rare earth compound powder.

(5) Volume of Pores with Pore Size of 20 nm or Less as Determined by Mercury Intrusion Porosimetry Alternatively or additionally to a volume of pores with a pore size of 3 to 20 nm of 0.08 $cm^3/g$ or more as determined by the gas absorption method, the rare earth compound powder preferably has a volume of pores with a pore size of 20 nm or less of 0.03 $cm^3/g$ or more as determined by mercury intrusion porosimetry, in view of more easily producing a uniform and thick coating without peeling etc. when the powder is used for producing a coating by the CS method. The inventors of the present invention thinks that the volume of small pores with a pore size of 20 nm or less at a certain level or more as determined by the mercury intrusion porosimetry also improves the efficiency in adhering the particles to a substrate when the particles are pressed against the substrate with high speed gas.

The volume of pores with a pore size of 20 nm or less as determined by the mercury intrusion porosimetry is a cumulative volume of pores with a pore size of 20 nm or less in a pore volume distribution as determined by the mercury intrusion porosimetry. The volume of pores with a pore size of 20 nm or less tends to be large when the crystallite diameter of the powder is as small as several to 10 or plus nm; however, the volume of pores with a pore size of 20 nm or less is a parameter that depends not only on the crystallite diameter but also on the particle shape or the form of the particle aggregate, and thus it cannot be assured that volumes of pores with a pore size of 20 nm or less nm are the same even when the BET specific surface areas or the crystallite diameters are the same.

In the CS material of the present invention, the volume of pores with a pore size of 20 nm or less as determined by the mercury intrusion porosimetry is preferably 0.03 $cm^3/g$ or more, more preferably 0.04 $cm^3/g$ or more, and even more preferably 0.05 $cm^3/g$ or more.

In the CS material, the volume of pores with a pore size of 20 nm or less as determined by the mercury intrusion porosimetry is preferably 0.3 $cm^3/g$ or less, and more preferably 0.25 $cm^3/g$ or less, in view of easily producing the CS material and securing the flowability of the material.

The pore volume as determined by the mercury intrusion porosimetry can be specifically obtained using a method described in Examples later.

A rare earth compound powder having a volume of pores with a pore size of 20 nm or less within the above-described range as determined by the mercury intrusion porosimetry can be produced using a later-described preferable method for producing a rare earth compound powder.

(6) Repose Angle

The CS material of the present invention preferably has a repose angle that is less than or equal to a certain angle. A material with a small repose angle has good flowability, and is thus smoothly conveyed to the CS apparatus. Accordingly, it is possible to perform coating stably, and it is thus easy to obtain a coating with good physical properties. The CS material preferably has a repose angle of 60° or less, more preferably 55° or less, and even more preferably 50° or less. On the other hand, a too small repose angle causes issues such as difficulty in handling of the powder due to too much flowability. From this viewpoint, the repose angle is preferably 10° or more, and more preferably 20° or more. The repose angle can be measured using a method described in Examples later.

A rare earth compound powder having a repose angle within the above-described range can be produced using a later-described preferable method for producing a rare earth compound powder.

(7) $D_{50N}$

The CS material of the present invention preferably has a cumulative volume particle size at a cumulative volume of 50 vol % as determined by a laser diffraction/scattering particle size distribution measurement, $D_{50N}$, of from 1 to 100 μm, more preferably from 1.5 to 80 μm, even more preferably from 2 to 60 μm, even more preferably from 5 to 60 μm, and even more preferably from 10 to 50 μm, in view of easily producing the CS material and securing the flowability, for example.

$D_{50N}$ is a particle size that is measured without ultrasonic treatment, and can be measured using a method described in Examples.

A rare earth compound powder having a $D_{50N}$ within the above-described range can be produced using a later-described preferable method for producing a rare earth compound powder.

(8) $D_{50D}$

In the case in which the CS material of the present invention is an aggregated powder or a granule, $D_{50}$ after ultrasonic treatment is influenced by crumbling or deagglomeration through the ultrasonic treatment, and typically is a value that is different from $D_{50N}$. The CS material of the present invention preferably has a cumulative volume particle size at cumulative volume of 50 vol % as determined by a laser diffraction/scattering particle size distribution measurement after ultrasonication at 300 W for 15 minutes, $D_{50D}$, of from 0.3 to 30 μm, and more preferably from 0.5 to 25 μm, in view of easily producing the CS material.

$D_{50D}$ can be measured using a method described in Examples.

A rare earth compound powder having a $D_{50D}$ within the above-described range can be produced using a later-described preferable method for producing a rare earth compound powder.

(9) Value L, Value a, and Value b

The CS material preferably has a value L of 85 or more and more preferably 90 or more in the L*a*b* color system, in view of obtaining a white coating, which is favorable, and preventing the rare earth compound from being altered, for example. From the same viewpoints, the CS material preferably has a value a of from −0.7 to 0.7 and more preferably from −0.5 to 0.5 in the L*a*b* color system. Also, the CS material preferably has a value b of from −1 to 2.5 and more preferably from −0.5 to 2.0 in the L*a*b* color system. The value L, the value a, and the value b in the L*a*b* color system can be measured using a method described in Examples. As in Comparative Example 5, which will be described later, a titanium oxide powder provides a coating with a color relatively significantly changed from that of the raw material, and the value a of the powder is lower than the above-described lower limit; thus a coating with a desired color tone may not be obtained from a titanium oxide powder.

A rare earth compound powder having a value L, value a, and value b in the L*a*b* color system within the above-described ranges can be produced using a later-described preferable method for producing a rare earth compound powder.

2. Method for Producing Powder of Compound of Rare Earth Element

Next, a method for producing a powder of a compound of a rare earth element suitable for the CS material of the present invention will be described.

(1) Method for Producing Powder of Rare Earth Element Oxide

In the case in which the rare earth compound is a rare earth element oxide, a powder of the rare earth element oxide (also referred to as a "rare earth oxide", hereinafter) is favorably produced by the following production method.

This production method includes: dissolving a powder of a rare earth element oxide in a warmed weakly acidic aqueous solution and then cooling down the solution to thereby allow a weak acid salt of the rare earth element to precipitate; and firing the weak acid salt at 450 to 950° C.

The compound type of rare earth oxide in a powder of a rare earth oxide as a raw material (also referred to as a "rare earth oxide as a raw material", hereinafter) in this production method may be the same as those listed above for the rare earth oxide used for the CS material. The powder of the rare earth oxide as a raw material preferably has a specific surface area of from 1 to 30 $m^2/g$ and more preferably from 1.5 to 25 $m^2/g$ as determined by the BET single-point method, in view of reducing the amount of the raw material remaining undissolved and impurities.

A weak acid is an acid with a small acidity constant, and is preferably an acid with pKa at 25° C. of 1.0 or more. In the case of a polybasic acid, the pKa herein is pKa1. In the case of a polybasic acid, the pKan (n is any integer of 2 or more) is preferably 3.0 or more. Examples of the acid with pKa of 1.0 or more include organic acids having a carboxylic acid group such as acetic acid, phosphoric acid, formic acid, butyric acid, lauric acid, lactic acid, malic acid, citric acid, oleic acid, linoleic acid, benzoic acid, oxalic acid, succinic acid, malonic acid, maleic acid, and tartaric acid, and inorganic acids such as boric acid, hypochlorous acid, hydrogen fluoride, and hydrosulfuric acid. Of these acids, organic acids having a carboxylic acid group are preferable, and in particular, acetic acid is preferable in view of both reducing the production cost and easily producing a rare earth oxide powder with desired physical properties. These acids may be used singly or in combination of two or more thereof.

The concentration of weak acid in the weakly acidic aqueous solution is preferably from 20 to 40% by mass, and more preferably from 25 to 35% by mass, in view of easily dissolving the powder of the rare earth oxide as a raw material, easily producing a powder of a rare earth element oxide with desired physical properties, and increasing the solubility of the raw material.

The amount of weakly acidic aqueous solution used to dissolve the powder of the rare earth oxide as a raw material is such that the amount of weak acid is preferably 120 mol or more, and more preferably 150 mol or more, per 100 mol of the rare earth oxide as a raw material, in view of sufficiently dissolving the powder of the rare earth oxide as a raw material in the weakly acidic aqueous solution and easily producing a rare earth oxide powder with desired physical properties. Furthermore, the amount of weak acid is preferably 800 mol or less per 100 mol of the rare earth oxide as a raw material, in view of low production cost.

The weakly acidic aqueous solution is warmed preferably to 60° C. or more, and more preferably to 80° C. or more, when the powder of the rare earth oxide as a raw material is dissolved in the weakly acidic aqueous solution, in view of sufficiently dissolving the powder of the rare earth oxide as a raw material in the weakly acidic aqueous solution and easily producing a rare earth oxide powder with desired physical properties. The upper limit of the temperature of the weakly acidic aqueous solution is preferably a boiling point under the atmospheric pressure.

When the weakly acidic aqueous solution in which the rare earth oxide as a raw material has been dissolved is cooled down, a rare earth weak acid salt precipitates. The rare earth weak acid salt precipitated is typically hydrate.

The precipitated rare earth weak acid salt is fired at 450 to 950° C. The firing atmosphere may be an oxygen-containing atmosphere such as air, or an inert atmosphere such as nitrogen or argon, but it is preferably an oxygen-containing atmosphere in view of reducing the amount of remaining organic matters derived from the weak acid. The firing temperature is preferably 950° C. or less, more preferably 925° C. or less, and even more preferably 900° C. or less, in view of obtaining a rare earth oxide having a specific surface area, a crystallite diameter, and a pore volume each in a desired range. The firing temperature is preferably 450° C. or more, and more preferably 475° C. or more, in view of obtaining a rare earth oxide powder with a desired crystal structure. The firing time in the above-described temperature range is preferably from 3 to 48 hours, and more preferably from 5 to 40 hours.

The precipitated rare earth weak acid salt may be washed or dried, for example, before firing. The drying in advance may be performed in an oxygen-containing atmosphere such as air or an inert atmosphere such as nitrogen or argon, and is preferably performed at a temperature of from room temperature to 250° C., and more preferably from 100 to 200° C., in view of easily producing a rare earth oxide powder with desired physical properties. The drying time in the above-described temperature range is preferably from 3 to 48 hours, and more preferably from 5 to 40 hours.

The rare earth oxide powder obtained through the firing may be used as the CS material, without any additional treatment or after treatment such as granulation. A favorable granulation treatment will be described later.

(2) Method for Producing Unfired Powder of Rare Earth Element Fluoride

In the case in which the rare earth compound is a rare earth element fluoride, a powder of the rare earth element fluoride (also referred to as a "rare earth fluoride", hereinafter) is favorably produced by the following production method. The following method is for producing an unfired powder of a rare earth element fluoride as the rare earth compound powder suitable for the CS material.

This production method is a method for producing an unfired powder of a rare earth fluoride, including: mixing an aqueous solution of a water-soluble salt of a rare earth element with hydrofluoric acid to thereby allow a rare earth fluoride to deposit; and drying the obtained deposit at 250° C. or less.

Examples of the water-soluble salt of the rare earth element include a nitrate, oxalate, acetate, ammine complex salt, and chloride of a rare earth element, and a rare earth element nitrate is preferable in view of availability and reducing the production cost.

The concentration of water-soluble salt of a rare earth element in the aqueous solution of the water-soluble salt of the rare earth element is preferably from 200 to 400 g/L, and more preferably from 250 to 350 g/L, in terms of the rare earth element oxide, in view of reactivity with hydrofluoric acid and stabilization of the physical properties of the deposit to be obtained.

The hydrofluoric acid is preferably used in the form of an aqueous solution having a hydrofluoric acid concentration of 40 to 60% by mass, and more preferably 45 to 55% by mass, in view of reactivity with rare earth water-soluble salt and securing the safety when handling.

The amount of hydrofluoric acid used is preferably 1.05 mol or more, and more preferably 1.1 mol or more, per 1 mol of rare earth element in the water-soluble salt of the rare earth element, in view of easily allowing the water-soluble salt of the rare earth element to sufficiently react to thereby obtain a rare earth fluoride powder with desired physical properties. The amount of hydrofluoric acid used is preferably 4.0 mol or less, and more preferably 3.0 mol or less, per 1 mol of rare earth element in the water-soluble salt of the rare earth element, in view of reducing the production cost.

The water-soluble salt of the rare earth element and hydrofluoric acid are allowed to react with each other preferably at 20 to 80° C., and more preferably 25 to 70° C., in view of easily allowing the water-soluble salt of the rare earth element to sufficiently react to thereby obtain a rare earth fluoride powder having a specific surface area, a crystallite diameter, a pore volume, etc., each in a desired range.

The reaction between the water-soluble salt of the rare earth element and hydrofluoric acid provides a deposit of a rare earth fluoride. In this production method, the deposit is dehydrated, washed, and then dried. The drying may be performed in an inert atmosphere such as nitrogen or argon, but is preferably performed in an oxygen-containing atmosphere, in view of efficiently drying the deposit after washing. The drying temperature is preferably 250° C. or less, more preferably 225° C. or less, and even more preferably 200° C. or less, in view of easily obtaining a rare earth fluoride powder having a specific surface area, a crystallite diameter, and a pore volume each in a desired range. The drying temperature is preferably 100° C. or more, and more preferably 120° C. or more, in view of efficiency in drying and reducing moisture residue. The drying time in the above-described temperature range is preferably from 3 to 48 hours, and more preferably from 5 to 40 hours.

In this production method, the expression "unfired powder of a rare earth fluoride" means that a rare earth fluoride obtained through the reaction between the water-soluble salt of the rare earth element and hydrofluoric acid is not fired. The expression "be not fired" here means preferably that the rare earth fluoride obtained through the reaction is not heated at 300° C. or more for 60 minutes or more, more preferably that the rare earth fluoride obtained is not heated at 250° C. or more for 60 minutes or more, and even more preferably that the rare earth fluoride obtained is not heated at 250° C. or more for 30 minutes or more.

Next, still another exemplary production method will be described, which is favorable for the case of producing a powder of a rare earth element oxyfluoride as the above-described rare earth compound powder suitable for the CS material.

(3) Method 1 for Producing Rare Earth Element Oxyfluoride

This production method includes: the first step of mixing, with hydrofluoric acid, a powder of a rare earth element oxide or a precursor that forms a rare earth element oxide when being fired, to thereby obtain a precursor of a rare earth element oxyfluoride; and the second step of firing the precursor of the rare earth element oxyfluoride.

The powder of the rare earth element oxide obtained through the method of (1) is preferably used as the powder of a rare earth element oxide as a starting material in the first step of the method of (3), in view of increasing the specific surface area of the oxyfluoride. That is to say, it is preferable to use a powder of a rare earth element oxide obtained by: dissolving a powder of a rare earth element oxide in a warmed weakly acidic aqueous solution and then cooling down the solution to thereby allow a weak acid salt of the rare earth element to precipitate; and firing the weak acid salt at 450 to 950° C. All of the descriptions for the method of (1) apply to the method for producing a powder of a rare earth element oxide that can be used as a starting material in the method of (3).

The precursor that forms a rare earth element oxide when being fired, which can be used as a starting material in the first step of the method of (3), is not limited as long as it is a compound that forms a rare earth element oxide when being fired in air. The firing temperature may be approximately from 500 to 900° C. Preferable examples of the precursor that forms a rare earth element oxide when being fired include a rare earth element oxalate and a rare earth element carbonate, in view of easily producing a fine powder. For example, the rare earth element carbonate is preferably obtained by allowing a water-soluble salt of the rare earth element and a hydrogen carbonate to react with each other, in view of increasing the specific surface area of a powder of a rare earth element oxyfluoride to be obtained. Examples of the water-soluble salt of the rare earth element include those listed above for the method of (2). In view of ease in handling and reduction in the production cost, a rare earth element nitrate and a rare earth element hydrochloride are preferable. Preferable examples of the hydrogen carbonate include an ammonium hydrogen carbonate, a sodium hydrogen carbonate, and a potassium hydrogen carbonate, in view of ease in handling and reduction in the production cost, for example. The water-soluble salt of the rare earth element and the hydrogen carbonate may be allowed to react with each other in an aqueous liquid such as water.

In the first step of the method of (3), a powder of a rare earth element oxide or a precursor that forms a rare earth element oxide when being fired is mixed with hydrofluoric acid, and thus a precursor of a rare earth element oxyfluoride is obtained. The mixing is preferably performed in water, in view of efficiently obtaining a precursor of a rare earth element oxyfluoride with physical properties preferable for the CS material, and also achieving a uniform reaction. From the same viewpoints, the temperature when mixing the powder of a rare earth element oxide or a precursor that forms a rare earth element oxide when being fired with the hydrofluoric acid is preferably from 10 to 80° C., and more preferably from 20 to 70° C. When mixing with the hydrofluoric acid, the powder of a rare earth element oxide or a precursor that forms a rare earth element oxide when being fired is preferably dispersed in water at a concentration, in terms of the rare earth element oxide, of 30 to 150 g/L, and more preferably 50 to 130 g/L.

The amount of hydrofluoric acid used is such that a hydrogen fluoride is preferably from 0.1 to 5.9 mol, and more preferably from 0.2 to 5.8 mol, per 1 mol, in terms of the oxide, of the rare earth element oxide or the precursor that forms a rare earth element oxide when being fired. The powder of rare earth element oxide or a precursor that forms a rare earth element oxide when being fired is mixed with the hydrofluoric acid preferably while stirring. For example, the stirring time is preferably from 0.5 to 48 hours, and more preferably from 1 to 36 hours, in view of successfully obtaining a target product and shortening the production time.

In the second step, the precursor of a rare earth element oxyfluoride obtained in the first step is fired, and thus a powder of a rare earth element oxyfluoride suitable for the CS material of the present invention is obtained. The firing is performed preferably in an oxygen-containing atmosphere such as air, in view of easily obtaining the rare earth element oxyfluoride. The firing temperature is preferably 200° C. or more, and more preferably 250° C. or more. The firing temperature is preferably 600° C. or less, and more preferably 550° C. or less, in view of easily obtaining a powder of a rare earth element oxyfluoride with the BET specific surface area and crystallite diameter described hereinbefore. The firing time in the above-described temperature range is preferably from 1 to 48 hours, and more preferably from 2 to 24 hours. The precursor of the rare earth element oxyfluoride is preferably dried before being fired. For example, the drying temperature is preferably from 100 to 180° C., and more preferably from 120 to 160° C., in view of efficiently obtaining a powder of a rare earth element oxyfluoride.

The powder of a rare earth element oxyfluoride obtained through the firing as is may be used as the CS material without any additional treatment; however, the powder is preferably crumbled, in view of facilitating the adhesion of the material to a substrate. Any of various methods described later may be used as the crumbling method.

The above-described rare earth compound powder suitable for the CS material may be produced using a method other than the above-described methods (1) to (3). For example, yet another exemplary production method (4) will be described, which is favorable for the case of producing a powder of a rare earth element oxyfluoride.

(4) Method 2 for Producing Rare Earth Element Oxyfluoride

This production method includes: mixing a powder of a rare earth element oxide and a powder of a rare earth element fluoride and firing the resulting mixture to thereby obtain a powder of a rare earth element oxyfluoride; and grinding the powder of a rare earth element oxyfluoride.

The powder of the rare earth element oxide as a starting material preferably has a specific surface area, as determined by the BET single-point method, of from 1 to 25 $m^2/g$, and more preferably from 1.5 to 20 $m^2/g$, in view of the cost, etc. Also, the powder of a rare earth element fluoride preferably has a specific surface area, as determined by the BET single-point method, of from 0.1 to 10 $m^2/g$, and more preferably from 0.5 to 5 $m^2/g$, in view of the cost, etc.

When mixing a powder of a rare earth element oxide and a powder of a rare earth element fluoride and then firing the resulting mixture, the firing atmosphere may be an oxygen-containing atmosphere such as air; however, when the firing temperature is 1100° C. or more, especially 1200° C. or more, the rare earth element oxyfluoride produced is likely to decompose in the oxygen-containing atmosphere to form a rare earth element oxide, and accordingly the firing atmosphere is preferably an inert atmosphere such as argon gas or an vacuum atmosphere. The firing temperature is preferably from 400 to 1000° C., and more preferably from 500 to 950° C., in view of easily obtaining a powder of a rare earth element oxyfluoride with physical properties suitable for the CS material. The firing time is preferably from 3 to 48 hours, and more preferably from 5 to 30 hours, for example.

In the method of (4), the powder of a rare earth element oxyfluoride obtained through the firing is ground. The grinding of the powder of a rare earth element oxyfluoride may be either dry grinding or wet grinding. For dry grinding, a dry ball mill, a dry bead mill, a high-speed rotary impact mill, a jet mill, a grinding stone mill, a roll mill, or the like can be used. For wet grinding, it is preferable to perform grinding using a wet grinder with a grinding medium in the shape of, for example, balls or cylinders. Examples of such a grinder include a ball mill, a vibration mill, a bead mill, and an Attritor (registered trademark). The grinding medium may be made of a material such as zirconia, alumina, silicon nitride, silicon carbide, tungsten carbide, abrasion resistant steel, or stainless steel. The zirconia may be stabilized by doped with a metal oxide. The dispersion medium for the wet grinding may be those listed below as examples of a dispersion medium for a slurry for use in granulation using a later-described spray drying method. The grinding medium used preferably has a diameter of 0.05 to 2.0 mm, and more preferably 0.1 to 1.0 mm, in view of obtaining a desired BET specific surface area. The amount of dispersion medium is preferably from 50 to 500 mL, and more preferably from 75 to 300 mL, per 100 g of the rare earth element oxyfluoride to be treated. The amount of the grinding medium is preferably from 50 to 1000 mL, and more preferably from 100 to 800 mL, per 100 g of the rare earth element oxyfluoride to be treated. The grinding time is preferably from 5 to 50 hours, and more preferably from 10 to 30 hours.

After wet grinding, the slurry obtained through the wet grinding is dried. In the case in which the slurry obtained through the wet grinding is dried to obtain a powder, the dispersion medium may be water; however, it is preferable to use an organic solvent as the dispersion medium and perform drying, in view of preventing aggregation through the drying. Examples of the organic solvent in this case include alcohol such as methanol, ethanol, 1-propanol, and 2-propanol, and acetone. The drying temperature is preferably from 80 to 200° C.

In this manner, it is possible to obtain a powder of a rare earth element oxyfluoride favorable for the CS material of the present invention.

The powder of a compound of a rare earth element obtained using any of the methods of (1) to (4) above as is may be used as a CS material without any additional treatment; however, the powder of a compound of a rare earth element obtained is preferably granulated before use to thereby increase the flowability, in view of ease in coating stably.

The granulating method may be, for example, a spray drying method, an extrusion granulating method, or a rolling granulating method. A spray drying method is preferable in view of good flowability of a granulated powder to be obtained and the favorable coat-forming properties when the powder is pressed against a substrate with high speed gas.

In the spray drying method, a slurry prepared by the rare earth fluoride powder obtained as described above in a dispersion medium is subjected to a spray drier. As the dispersion medium, water and various organic solvents may be used singly or in combination of two or more. Of these, it is preferable to use water, an organic solvent with a solubility to water of 5% by mass or more, or a mixture of such an organic solvent and water, in view of obtaining a denser and more uniform coating. The organic solvent with a solubility to water of 5% by mass or more encompasses those that freely mix with water. The mixing ratio between the organic solvent with a solubility to water of 5% by mass or more and water in the mixture is preferably within the range of the solubility of the organic solvent to water.

Examples of the organic solvent with a solubility to water of 5% by mass or more (including those that freely mix with water) include alcohols, ketones, cyclic ethers, formamides, and sulfoxides.

Examples of the alcohols include monohydric alcohols such as methanol (methyl alcohol), ethanol (ethyl alcohol), 1-propanol (n-propyl alcohol), 2-propanol (iso-propyl alcohol, IPA), 2-methyl-1-propanol (iso-butyl alcohol), 2-methyl-2-propanol (tert-butyl alcohol), 1-butanol (n-butyl alcohol), and 2-butanol (sec-butyl alcohol), and polyhydric alcohols such as 1,2-ethanediol (ethylene glycol), 1,2-propanediol (propylene glycol), 1,3-propanediol (trimethylene glycol), and 1,2,3-propanetriol (glycerin).

Examples of the ketones include propanone (acetone) and 2-butanone (methyl ethyl ketone, MEK). Examples of the cyclic ether include tetrahydrofuran (THF) and 1,4-dioxane. Examples of the formamides include N,N-dimethylformamide (DMF). Examples of the sulfoxides include dimethyl sulfoxide (DMSO). These organic solvents may be used singly or in combination of two or more.

The content of the rare earth compound powder in the slurry is preferably from 10 to 50% by mass, more preferably from 12 to 45% by mass, and even more preferably from 15 to 40% by mass. With a content in this range, a coating can be formed from the slurry in a relatively short period of time (in other words, the coating efficiency is good), and the uniformity of a coating to be obtained is also better.

In the spray drying, a spray drier is preferably operated in the following conditions. The rate of the slurry fed is preferably from 150 to 350 mL/min, and more preferably from 200 to 300 mL/min. In the case of a rotary atomizer, the number of rotations of the atomizer is preferably from 5000 to 30000 $min^{-1}$, and more preferably from 6000 to 25000 $min^{-1}$. The inlet temperature is preferably from 200 to 300° C., and more preferably from 230 to 270° C.

The powder of a compound of a rare earth element obtained using any of the methods of (1) to (4) above may be crumbled before granulation or without granulation, so that their $D_{50D}$ and $D_{50N}$ are adjusted to a desired range.

The crumbling may be either wet grinding or dry grinding. For dry grinding, a pin mill, a crusher, a dry ball mill, a dry bead mill, a high-speed rotary impact mill, a jet mill, a grinding stone mill, a roll mill, an atomizer, or the like can be used. For wet grinding, it is preferable to perform grinding using a wet grinder with a grinding medium in the shape of, for example, balls or cylinders. Examples of such a grinder include a ball mill, a vibration mill, a bead mill, and an Attritor (registered trademark).

The rare earth compound powders obtained through the methods of (1) to (4) above have excellent coat-forming properties when used for coating by the CS method, and thus they are useful as CS materials.

3. Coating by CS Method

Next, the coating method by the CS method will be described.

The CS method is a technique for forming a coating by, without melting or gasifying a powder material, causing the powder material in a solid phase at the melting temperature or lower to collide against a substrate, thereby causing plastic deformation of the powder material by the energy at the collision.

In the coating method, the CS material of the present invention is used as a raw material powder, and the raw material powder is heated and accelerated with heated and pressurized gas, and is caused to collide against a substrate to thereby form a coating.

For example, a coating apparatus for use in coating by the CS method include; a generating section that generates high temperature and high pressure gas; a gas-accelerating section that receives the high temperature and high pressure gas from the generating section and accelerates the gas; and a substrate-holding section that holds a substrate, wherein a raw material powder is added in the flow of the high temperature and high pressure gas, so that the raw material powder is caused to collide against the substrate.

The temperature of the high temperature and high pressure gas from the generating section is preferably 150° C. or more, in view of easily causing the rare earth compound particles to adhere to the substrate, and is preferably 800° C. or less, in view of preventing contamination with metal impurities from the acceleration nozzle. From these viewpoints, the gas temperature is preferably from 160 to 750° C., and more preferably from 180 to 700° C.

The pressure of the high temperature and high pressure gas from the generating section is preferably 0.1 MPa or more, in view of easily causing the particles to adhere to the substrate, and is preferably 10 MPa or less, in view of preventing a phenomenon in which shock waves generated near the substrate surface inhibit collision of the particles against the substrate. From these viewpoints, the gas pressure is preferably from 0.2 to 8 MPa, and more preferably from 0.3 to 6 MPa.

The gas-accelerating section may include an acceleration nozzle, and there is no limitation on the shape or structure of the acceleration nozzle.

The substrate may be made of, for example, metal such as aluminum, aluminum alloy, stainless steel, or carbon steel, ceramic such as graphite, quartz, or alumina, or plastic.

The gas may be compressed air, nitrogen, or helium, for example.

There is no limitation on the position of a substrate in the substrate-holding section as long as the substrate is exposed to the flow of high temperature and high pressure gas. The substrate-holding section and the substrate may be fixed to each other. The substrate is preferably moved vertically and/or horizontally to expose the entire substrate to the flow of high temperature and high pressure gas, so that a uniform coating is formed thereon. The distance between the ejecting port for the raw material powder and the substrate (also referred to as a "coating distance", hereinafter) is preferably from 10 to 50 mm, and more preferably from 15 to 45 mm, in view of ease in coating.

4. Cold Sprayed Coating

Next, a cold sprayed coating obtained by subjecting the CS material of the present invention to the CS method will be described.

In the cold sprayed coating of the present invention, the maximum peak exhibited at 2θ=10 to 90° in X-ray diffractometry using Cu-Kα rays or Cu-$K\alpha_1$ rays is preferably assigned to a rare earth compound. In the case in which the cold sprayed coating exhibits a main peak assigned to a rare earth compound at 2θ=10 to 90° in X-ray diffractometry, the height of a maximum intensity peak assigned to a component other than the rare earth compound is preferably 10% or less, more preferable 5% or less, based on the height of the main peak, and it is even more preferable that no peak assigned to a component other than the rare earth compound should be exhibited. In particular, in the case in which the main peak is assigned to a rare earth element oxide, a rare earth element fluoride, or a rare earth element oxyfluoride, the height of a maximum intensity peak assigned to a component other than the rare earth element oxide, rare earth element fluoride, or rare earth element oxyfluoride is preferably 10% or less, more preferably 5% or less, based on the height of the main peak, and it is even more preferable that no peak assigned to a component other than the rare earth element oxide, rare earth element fluoride, or rare earth element oxyfluoride should be exhibited.

Moreover, in the case in which the cold sprayed coating of the present invention exhibits a main peak assigned to a rare earth element oxide at 2θ=10 to 90° in X-ray diffractometry, the height of a maximum intensity peak assigned to a component other than the rare earth element oxide may be 10% or less, or 5% or less, based on the main peak.

In the case in which the cold sprayed coating of the present invention exhibits a main peak assigned to a rare earth element fluoride at 2θ=10 to 90° in X-ray diffractometry, the height of a maximum intensity peak assigned to a component other than the rare earth element fluoride may be 10% or less, or 5% or less, based on the main peak.

In the case in which the cold sprayed coating of the present invention exhibits a main peak assigned to a rare earth element oxyfluoride at 2θ=10 to 90° in X-ray diffractometry, the height of a maximum intensity peak assigned to a component other than the rare earth element oxyfluoride may be 10% or less, or 5% or less, based on the main peak.

The X-ray diffractometry on the cold sprayed coating can be carried out using a method described in Examples.

The thickness of the cold sprayed coating of the present invention is preferably 20 μm or more, in view of sufficiently providing halogen-based plasma resistance when serving as a coating of a constituent element of semiconductor production equipment, and is preferably 500 μm or less, in view of obtaining a coating suitable for applications and also from the economical viewpoint. Furthermore, the coating obtained in the present invention preferably has a value L of 85 or more, and more preferably 90 or more, in the L*a*b* color system. From the same viewpoints, the cold sprayed coating of the present invention preferably has a value a of from −0.7 to 0.7, and more preferably from −0.5 to 0.5 in the L*a*b* color system. Furthermore, the cold sprayed coating of the present invention preferably has a value b of from −1 to 2.5, and more preferably from −0.5 to 2.0 in the L*a*b* color system. The value L, the value a, and the value b in the L*a*b* color system can be measured using a method described in Examples.

The cold sprayed coating of the present invention preferably has a crystallite diameter of 25 nm or less, more preferably 23 nm or less, and even more preferably 20 nm or less, in view of producing a dense coating. The crystallite diameter is preferably 1 nm or more, and more preferably 3 nm or more, in view of easily producing a cold sprayed coating and securing the strength of a cold sprayed coating to be obtained. The crystallite diameter can be measured using a method described in Examples below.

The cold sprayed coating can be used for constituent elements of various plasma processing apparatuses and chemical plants, as well as constituent elements of semiconductor production equipment.

The cold sprayed coating herein is defined as a coating obtained through the CS method. This definition indicates the state of a product, and does not intend to specify the process for producing the product. Furthermore, even if it would have to be said that such a description indicates a process for producing the product, it has been natural that defining the product directly on the basis of the structure or characteristics is impossible or rather impractical at the filing of this application because investigation for revealing all characteristics brought about through the production by the CS method is difficult with regard to the invention, for which the application needs early filing.

EXAMPLES

Hereinafter, the present invention will be described in more detail by way of examples. However, the scope of the present invention is not limited to these examples. Unless otherwise described, "%" means "% by mass". All BET specific surface areas mentioned below were measured using the method described below.

Example 1

160 g of yttrium oxide powder with a BET specific surface area of 3.0 $m^2/g$ was dissolved in 1 kg of 30% acetic acid aqueous solution warmed at 100° C., and the mixture was then cooled down to room temperature to precipitate yttrium acetate hydrate. After solid-liquid separation, the yttrium acetate hydrate obtained was dried at 120° C. for 12 hours and then fired at 650° C. for 24 hours to obtain an yttrium oxide powder. Both the drying and the firing were performed in air. When the obtained yttrium oxide powder was subjected to X-ray diffractometry in the scanning range 2θ=10 to 90° in the following conditions, a main peak assigned to an yttrium oxide was exhibited at 20.1 to 21.0°, and the height of a maximum intensity peak assigned to a component other than yttrium oxide was 5% or less based on the height of the main peak.

Example 2

160 g of yttrium oxide powder with a BET specific surface area of 3.0 $m^2/g$ was dissolved in 1 kg of 30% acetic acid aqueous solution warmed at 100° C., and the mixture was then cooled down to room temperature to precipitate yttrium acetate hydrate. After solid-liquid separation, the yttrium acetate hydrate obtained was dried at 120° C. for 12 hours and then fired at 550° C. for 24 hours to obtain an yttrium oxide powder. Both the drying and the firing were performed in air. When the obtained yttrium oxide powder was subjected to X-ray diffractometry in the scanning range 2θ=10 to 90° in the following conditions, a main peak assigned to an yttrium oxide was exhibited at 20.1 to 21.0°, and the height of a maximum intensity peak assigned to a component other than yttrium oxide was 5% or less based on the height of the main peak.

Comparative Example 1

160 g of yttrium oxide powder with a BET specific surface area of 3.0 $m^2/g$ was dissolved in 1 kg of 30% acetic acid aqueous solution warmed at 100° C., and the mixture was then cooled down to room temperature to precipitate yttrium acetate hydrate. After solid-liquid separation, the yttrium acetate hydrate obtained was dried at 120° C. for 12 hours and then fired at 1000° C. for 24 hours to obtain an yttrium oxide powder. Both the drying and the firing were performed in air.

Example 3

2.2 kg of yttrium nitrate aqueous solution having a concentration of 300 g/L in terms of yttrium oxide and 0.5 kg of 50% hydrofluoric acid were poured in a reaction vessel, and the mixture was then allowed to react at 40° C. to obtain a deposit of yttrium fluoride. The obtained deposit was dehydrated and washed, and then dried in air at 150° C. for 24 hours.

The obtained dry powder was dispersed in pure water to a concentration of 20%. The obtained dispersion was subjected to granulation using a spray drier FOC-20 manufactured by Ohkawara Kakohki Co., Ltd. The spray drier was operated in the following conditions: rate of slurry fed; 245 mL/min, number of rotations of atomizer; 12000 $min^{-1}$, and inlet temperature; 250° C. A granulated powder of an yttrium fluoride was obtained through the above-described steps without firing. When the obtained yttrium fluoride powder was subjected to X-ray diffractometry in the scanning range 2θ=10 to 90° in the conditions described later, a main peak assigned to an yttrium fluoride was exhibited at 27.0 to 28.0°, and the height of a maximum intensity peak assigned to a component other than yttrium fluoride was 5% or less based on the main peak.

Comparative Example 2

2.2 kg of yttrium nitrate aqueous solution having a concentration of 300 g/L in terms of yttrium oxide and 0.5 kg of 50% hydrofluoric acid were poured in a reaction vessel, and the mixture was allowed to react at 40° C. to obtain a deposit of yttrium fluoride. The obtained deposit was dehydrated and washed, and then dried in air at 150° C. for 24 hours.

The obtained dry powder was dispersed in pure water to a concentration of 20%. The obtained dispersion was subjected to granulation using a spray drier FOC-20 manufactured by Ohkawara Kakohki Co., Ltd. The spray drier was operated in the following conditions: rate of slurry fed; 245 mL/min, number of rotations of atomizer; 12000 $min^{-1}$, and inlet temperature; 250° C. The obtained granulated powder was sintered in air at 400° C. for 24 hours to obtain a granulated powder of yttrium fluoride.

Comparative Example 3

A granulated powder of yttrium fluoride was obtained in the same manner as in Comparative Example 2, except that a commercially available yttrium fluoride powder (BET specific surface area 3.6 $m^2/g$), instead of the dry powder of the deposit, was granulated using a spray drying method.

Example 4

0.61 kg of yttrium oxide powder with a BET specific surface area of 3.0 $m^2/g$ and 0.39 kg of yttrium fluoride powder with BET specific surface area of 1.0 $m^2/g$ were mixed, and the mixture was then fired in air at 900° C. for 5 hours to obtain an yttrium oxyfluoride powder. It was confirmed that the composition of obtained powder was YOF having a molar ratio Y:O:F of 1:1:1.

The obtained yttrium oxyfluoride powder was subjected to wet grinding at a concentration of 50% in denatured alcohol for 15 hours using a UAM-1 manufactured by Hiroshima Metal & Machinery Co., Ltd. Grinding beads used were those made of a zirconium oxide with a diameter of 0.1 mm. The amount of the beads used was 100 ml per 100 g of yttrium oxyfluoride. The powder obtained through wet grinding was dried in air at 120° C. for 24 hours.

The obtained dry powder was dispersed in pure water to a concentration of 35%, and the resultant was then subjected to granulation using a spray drier FOC-16 manufactured by Ohkawara Kakohki Co., Ltd. to obtain a granulated powder of yttrium oxyfluoride. The spray drier was operated in the following conditions: rate of slurry fed; 245 mL/min, number of rotations of atomizer; 12000 $min^{-1}$, and inlet temperature; 250° C.

When the obtained yttrium oxyfluoride powder was subjected to X-ray diffractometry in the scanning range 2θ=10 to 90° in the conditions described later, a main peak assigned to YOF was exhibited at 28 to 29°, and the height of a maximum intensity peak assigned to a component other than YOF was 5% or less based on the height of the main peak.

Example 5

160 g of yttrium oxide powder with a BET specific surface area of 3.0 $m^2/g$ was dissolved in 1 kg of 30% acetic acid aqueous solution warmed at 100° C., and the mixture was then cooled down to room temperature to precipitate yttrium acetate hydrate. After solid-liquid separation, the yttrium acetate hydrate obtained was dried at 120° C. for 12 hours and then fired at 650° C. to obtain an yttrium oxide powder. Both the drying and the firing were performed in air.

The obtained yttrium oxide powder was dispersed in pure water to a concentration of 70 g/L, and 50% hydrofluoric acid was added thereto such that the content of hydrogen fluoride in the resulting mixture was 18 g per 100 g of yttrium oxide. The mixture was stirred at 25° C. for 24 hours to obtain a precursor of yttrium oxyfluoride. The precursor was dehydrated, and then dried in air at 120° C. for 24 hours. The obtained dry powder was fired in air at 400° C. for 5 hours and then crumbled using a pin mill (Kolloplex manufactured by Powrex Corporation) at a number of rotations of 5000 rpm to obtain an yttrium oxyfluoride powder.

When the obtained yttrium oxyfluoride powder was subjected to X-ray diffractometry in the scanning range 2θ=10 to 90° in the conditions described later, it was confirmed that the composition of the obtained powder was YOF having a molar ratio Y:O:F of 1:1:1. In the X-ray diffractometry, a main peak assigned to YOF was exhibited at 28 to 29°, and the height of a maximum intensity peak assigned to a component other than YOF were 5% or less based on the height of the main peak.

Example 6

1 L of yttrium nitrate aqueous solution having a concentration of 300 g/L in terms of yttrium oxide and 0.7 L of ammonium hydrogen carbonate aqueous solution having a concentration of 250 g/L were mixed, and the yttrium nitrate and the ammonium hydrogen carbonate were allowed to react with each other to obtain a deposit of yttrium carbonate. The obtained deposit was dehydrated and washed, and then dried in air at 120° C. for 24 hours.

The obtained yttrium carbonate powder was dispersed in pure water to a concentration of 70 g/L in terms of yttrium oxide, and 50% hydrofluoric acid was added thereto such that the content of hydrogen fluoride in the resulting mixture was 18 g per 100 g of yttrium carbonate in terms of yttrium oxide. The mixture was stirred at 25° C. for 24 hours to obtain a precursor of yttrium oxyfluoride. The precursor was dehydrated, and then dried in air at 120° C. for 24 hours. The obtained dry powder was fired in air at 400° C. for 5 hours and then crumbled using a pin mill (Kolloplex manufactured by Powrex Corporation) at a number of rotations of 5000 rpm to obtain an yttrium oxyfluoride powder.

When the obtained yttrium oxyfluoride powder was subjected to X-ray diffractometry in the scanning range 2θ=10 to 90° in the conditions described later, it was confirmed that the composition of the obtained powder was YOF having a molar ratio Y:O:F of 1:1:1. In the X-ray diffractometry, a main peak assigned to YOF was exhibited at 28.0 to 29.0°, and the height of a maximum intensity peak assigned to a component other than YOF was 5% or less based on the height of the main peak.

Example 7

0.47 kg of yttrium oxide powder with a BET specific surface area of 3.0 $m^2/g$ and 0.53 kg of yttrium fluoride powder with BET specific surface area of 1.0 $m^2/g$ were mixed, and the mixture was then fired in air at 900° C. for 5 hours to obtain an yttrium oxyfluoride powder.

The obtained yttrium oxyfluoride powder was subjected to wet grinding at a concentration of 50% in denatured alcohol for 15 hours using a UAM-1 manufactured by Hiroshima Metal & Machinery Co., Ltd, and then dried in air at 120° C. for 24 hours. Grinding beads used were those made of a zirconium oxide with a diameter of 0.1 mm. The amount of the beads used was 0.1 L per 100 g of yttrium oxyfluoride.

The obtained dry powder was dispersed in pure water to a concentration of 35%, and the resultant was then subjected to granulation using a spray drier FOC-16 manufactured by Ohkawara Kakohki Co., Ltd. to obtain a granulated powder of yttrium oxyfluoride. The spray drier was operated in the following conditions: rate of slurry fed; 245 mL/min, number of rotations of atomizer; 12000 $min^{-1}$, and inlet temperature; 250° C.

When the obtained yttrium oxyfluoride powder was subjected to X-ray diffractometry in the scanning range 2θ=10 to 90° in the conditions described later, it was confirmed that the composition of the obtained powder was $Y_5O_4F_7$ having a molar ratio Y:O:F of 5:4:7. In the X-ray diffractometry, a main peak assigned to $Y_5O_4F_7$ was exhibited at 28.0 to 29.0°, and the height of a maximum intensity peak assigned to a component other than $Y_5O_4F_7$ were 5% or less based on the height of the main peak.

Comparative Example 4

A granulated powder of yttrium oxyfluoride was obtained in the same manner as in Comparative Example 2, except that a commercially available yttrium oxyfluoride powder (BET specific surface area 3.1 $m^2/g$), instead of the dry powder of the deposit, was granulated using a spray drying method.

Comparative Example 5

A $TiO_2$ aggregated powder (manufactured by Tayca Corporation) was used.

For each of the obtained powders of Examples and Comparative examples, the BET specific surface area, the crystallite diameter, the volume of pores with a pore size of 20 nm or less as determined by the mercury intrusion porosimetry, the volume of pores with a pore size of 3 to 20 nm as determined by the gas absorption method, the repose angle, the $D_{50N}$ and the $D_{50D}$, and the value L, the value a and the value b were determined using the following methods. The composition of the powder was analyzed by X-ray diffractometry in the following conditions.

Table 1 below shows the results.

BET Specific Surface Area

The measurement was performed using a BET single-point method with a full automatic specific surface area analyzer Macsorb model-1201 manufactured by Mountech Co., Ltd. The gas used was a mix gas of nitrogen and helium (nitrogen: 30 vol %).

Crystallite Diameter

The powder was subjected to X-ray diffractometry in the following conditions, and the crystallite diameter was determined using the Scherrer's equation ($D=K\lambda/(\beta \cos \theta)$), wherein, D represents the crystallite diameter, λ represents the wavelength of an X-ray, β represents the width of the diffraction line (half width), θ represents the diffraction angle, and K represents the constant. The half width was obtained from K=0.94.

In the scanning range 2θ=10 to 90°, the half width of a peak on the (222) plane was used for an yttrium oxide, the half width of a peak on the (111) plane was used for an yttrium fluoride, the half width of a peak on the (101) plane of YOF was used for an oxyfluoride of Examples 4 to 6, and the half width of a peak on the (151) plane of $Y_5O_4F_7$ was used for an oxyfluoride of Example 7 and Comparative Example 4. The half width of a peak on the (101) plane at 2θ=25.218° was used for Comparative Example 5.

The conditions of X-ray diffraction were as follows.

Diffractiometer: UltimaIV (manufactured by Rigaku Corporation)
Radiation source: CuKα rays
Tube voltage: 40 kV
Tube current: 40 mA
Scanning speed: 2°/min
Step: 0.02°
Scanning range: 2θ=10 to 90°

For X-ray diffractometry, 50 g of the powder of any of Examples and Comparative Examples was weighed and put into an agate mortar, and ethanol was added dropwise thereto in an amount such that the powder was completely covered. After 10 minutes, the resultant was manually ground with an agate pestle and dried, and the resultant was passed through a sieve with an opening size of 250 μm. The particles passed through the sieve were subjected to X-ray diffractometry.

Pore Volume as Determined by Mercury Intrusion Porosimetry

The measurement was performed according to JIS R1655: 2003 using an AutoPore IV manufactured by Micromeritics. Specifically, 0.35 g of the sample was used, and intrusion of mercury was carried out at an initial pressure of 7 kPa. The contact angle of mercury on the measurement sample was set to 130°, and the surface tension of mercury was set to 485 dynes/cm. The measurement was performed in the pore size range from 0.001 to 100 μm, and the result was analyzed using attached analysis software to determine a cumulative volume in the pore size range of 20 nm or less as a pore volume.

Pore Volume as Determined by Gas Absorption Method

The measurement was performed using a BET multi-point method with a Nova2200 manufactured by Quantachrome Instruments. Nitrogen gas was used as an adsorption medium. The obtained adsorption/desorption curve was analyzed using a Dollimore-Heal method, and the average of cumulative values of pore volumes determined in the pore size range from 3 to 20 nm in the adsorption process and the desorption process was taken as a pore volume.

Repose Angle

The measurement was performed according to JIS R 9301 using a measuring instrument of multi-functional powder characteristics analyzer Multi Tester MT-1001k (manufactured by Seishine Corporation).

$D_{50N}$ and $D_{50D}$

The powder was fed to the pure water-containing chamber of the sample circulator of Microtrac 3300EXII manufactured by Nikkiso Co., Ltd. until the analyzer determined that the concentration reached a proper concentration, and then $D_{50N}$ was measured.

For measurement of $D_{50D}$, about 0.4 g of powder was placed into a 100-mL glass beaker, and then pure water as a dispersion medium was poured thereto to the marked line of 100 mL of the beaker. The beaker containing the particles and the dispersion medium was set in an ultrasonic homogenizer US-300T (output: 300 W) manufactured by Nihonseiki Kaisha Ltd., and the content was subjected to ultrasonic treatment for 15 minutes to obtain a slurry for measurement. The slurry for measurement was fed dropwise to the pure water-containing chamber the sample circulator of Microtrac 3300EXII manufactured by Nikkiso Co., Ltd. until the analyzer determined that the concentration reached a proper concentration, and then $D_{50D}$ was measured.

Value L, Value a, and Value b

The measurement was performed using a spectrophotometer CM-700d manufactured by Konica Minolta, Inc.

Evaluation of Coating

The powders obtained in Examples 1 to 7 and Comparative Examples 1 to 5 were used to form coatings using the CS method in the following conditions.

- Coating apparatus: ACGS manufactured by Medicoat was used as a coating apparatus to form coatings from the powders of Examples 1 and 2, Comparative Example 1, and Examples 4 to 7. DYMET413 manufactured by Russian company OCPS was used as a coating apparatus to form coatings from the powders of Example 3 and Comparative Examples 2 to 5.
- Working gas: Compressed air was used for Example 3 and Comparative Examples 2 and 3, and $N_2$ was used in other Examples and Comparative Examples.
- Working gas pressure at high temperature and high pressure gas-generating section: 0.5 MPa (3 MPa only for Comparative Example 5)
- Working gas temperature: 550° C.
- Flow rate of working gas: 270 L/min
- Nozzle: A nozzle attached to a DYMET413 manufactured by Russian company OCPS was used.
- Substrate: An aluminum plate with a size of 50 mm×50 mm was used.
- The coating distance was set to 20 mm.
- The powder was fed to the nozzle using the apparatus shown in the FIGURE in the following manner. First, 0.5 kg of powder was placed in a powder feeder 11, and fed to a tube 12 by vibrations. The powder fed to the tube 12 was carried by gas flowing from a gas pipe 13 to a nozzle 14 in a direction indicated by the arrow to feed to the nozzle 14, and ejected from the nozzle 14 toward a substrate 15.
- The substrate 15 was moved vertically and horizontally at a speed of 20 mm/sec, so that the coating was uniformly deposited on the substrate.

The coat-forming properties in the above-described coating methods were evaluated according to the following evaluation criteria. The coating thickness was measured under a scanning electron microscope after polishing a cross-section of the coating with a diamond slurry. Also, the crystallite diameter of the coating was evaluated according to the following method.

Coat-Forming Properties

Excellent: A uniform and thick coating with a thickness of 20 μm or more was obtained.

Good: A thick coating with a thickness of 20 μm or more was obtained, but there was a portion in which the coating was peeled away or was not formed.

Poor: A coating was not formed.

Crystallite Diameter

The coating formed on the substrate surface was subjected to X-ray diffractometry in the following conditions.

The crystallite diameter was determined using the Scherrer's equation $(D=K\lambda)/(\beta \cos \theta))$, wherein D represents the crystallite diameter, λ represents the wavelength of an X-ray, β represents the width of the diffraction line (half width), θ represents the diffraction angle, and K represents the constant. The half width was obtained from K=0.94.

In the scanning range 2θ=10 to 90°, the half width of a peak on the (222) plane was used for an yttrium oxide, the half width of a peak on the (111) plane was used for an yttrium fluoride, the half width of a peak on the (101) plane of YOF was used for an yttrium oxyfluoride of Examples 4 to 6, and the half width of a peak on the (151) plane of $Y_5O_4F_7$ was used for an yttrium oxyfluoride of Example 7 and Comparative Example 4. The half width of a peak on the (101) plane at 2θ=25.2180 of a titanium oxide was used for Comparative Example 5.

The conditions of X-ray diffraction were as follows.

- Diffractometer: UltimaIV (manufactured by Rigaku Corporation)
- Radiation source: CuKα rays
- Tube voltage: 40 kV
- Tube current: 40 mA
- Scanning speed: 2°/min
- Step: 0.02°
- Scanning range: 2θ=10 to 90°

For X-ray diffractometry, 50 g of the coating of any of Examples and Comparative Examples was weighed and put into an agate mortar, and ethanol was added dropwise thereto in an amount such that the coating was completely covered. After 10 minutes, the resultant was manually ground with an agate pestle and dried, and the resultant was passed through a sieve with an opening size of 250 μm. The particles passed through the sieve was subjected to X-ray diffractometry.

In the X-ray diffraction patterns of the coatings obtained using the CS method in Examples, the height ratios between a main peak and a maximum intensity peak of another component were the same as in the X-ray diffraction patterns of the powders of Examples.

Value L, Value a, and Value b

The measurement was performed using a spectrophotometer CM-700d manufactured by Konica Minolta, Inc.

TABLE 1

| | Power physical properties | | | | | | |
|---|---|---|---|---|---|---|---|
| | Composition | Form | BET specific surface area ($m^2/g$) | Crystallite diameter (nm) | Pore volume as determined by mercury intrusion porosimetry (20 nm or less, $m^3/g$) | Pore volume as determined by gas absorption method (3-20 nm, $m^3/g$) | Repose angle (°) |
| Ex. 1 | Y2O3 | Aggregated powder | 76.0 | 13 | 0.138 | 0.318 | 45 |
| Ex. 2 | Y2O3 | Aggregated powder | 102.0 | 12 | 0.147 | 0.475 | 47 |
| Com. Ex. 1 | Y2O3 | Aggregated powder | 20.9 | 32 | 0.019 | 0.047 | 48 |
| Ex. 3 | YF3 | Granule | 55.6 | 9 | 0.062 | 0.396 | 29 |
| Com. Ex. 2 | YF3 | Granule | 15.8 | 27 | 0.002 | 0.069 | No flowability |
| Com. Ex. 3 | YF3 | Granule | 3.6 | 62 | 0.000 | 0.013 | 22 |
| Ex. 4 | YOF | Granule | 59.2 | 14 | 0.161 | 0.313 | 26 |
| Ex. 5 | YOF | Aggregated powder | 44.8 | 15 | 0.024 | 0.213 | 37 |
| Ex. 6 | YOF | Aggregated powder | 106.2 | 7 | 0.003 | 0.420 | 39 |
| Ex. 7 | Y5O4F7 | Granule | 51.1 | 18 | 0.177 | 0.241 | 26 |
| Com. Ex. 4 | Y5O4F7 | Granule | 3.1 | 65 | 0.000 | 0.013 | 22 |
| Com. Ex. 5 | TiO2 | Aggregated powder | 233.0 | — | — | — | 46 |

| | Power physical properties | | | | | | Properties of coating | | | |
|---|---|---|---|---|---|---|---|---|---|---|
| | D50D (μm) | D50N (μm) | Value L (—) | Value a (—) | Value b (—) | Coat-forming properties | Crystallite diameter (nm) | Value L (—) | Value a (—) | Value b (—) |
| Ex. 1 | 3.7 | 21.2 | 99.4 | 0.14 | −0.06 | Excellent | 12 | 90.12 | −0.53 | 0.22 |
| Ex. 2 | 4.1 | 23.9 | 96.3 | 0.37 | 0.65 | Excellent | 11 | 90.16 | −0.49 | 0.19 |
| Com. Ex. 1 | 3.5 | 23.8 | 99.8 | 0.04 | 0.18 | Poor | Failed in coating | 94.34 | −0.24 | 0.11 |
| Ex. 3 | 2.3 | 48.4 | 99.3 | −0.20 | 1.54 | Excellent | 9 | 94.14 | −1.14 | 0.31 |
| Com. Ex. 2 | 3.4 | 45.2 | 93.0 | 0.38 | 3.72 | Poor | Failed in coating | 92.12 | −0.32 | 0.45 |
| Com. Ex. 3 | 1.0 | 46.0 | 98.7 | 0.19 | 0.57 | Poor | Failed in coating | 68.34 | 0.24 | 1.24 |
| Ex. 4 | 24.0 | 36.0 | 95.9 | −0.06 | 1.73 | Excellent | 11 | 90.32 | −0.34 | 0.01 |
| Ex. 5 | 1.0 | 3.0 | 99.4 | 0.11 | 0.38 | Good | 14 | 90.34 | −0.54 | 0.12 |
| Ex. 6 | 4.1 | 5.0 | 99.5 | −0.01 | 0.23 | Good | 6 | 92.32 | −0.34 | 0.15 |
| Ex. 7 | 18.0 | 35.6 | 97.1 | −0.12 | 0.98 | Excellent | 17 | 94.30 | −0.34 | 0.20 |
| Com. Ex. 4 | 0.8 | 46.0 | 100.0 | 0.16 | 0.12 | Poor | Failed in coating | 87.69 | 0.24 | 1.24 |
| Com. Ex. 5 | 8.1 | 9.0 | 98.9 | −0.77 | 2.68 | Excellent | 8 | 85.77 | −3.62 | 18.69 |

(—) means not measured.

Table 1 shows the following. In all Examples, a coating with a thickness of 20 m or more was formed by the CS method from the materials of the present invention, and the crystallite diameter, the value L, the value a, and the value b of each obtained coating were almost the same as those of the material powder. On the other hand, the powders of Comparative Examples 1 to 4 failed to form a coating by the CS method. Also, in Comparative Example 5, in which $TiO_2$ was used, the resulting coating had a significantly increased value b, and a less yellowish, white coating was not obtained.

The invention claimed is:

1. A material for cold spraying, comprising a powder of a compound of a rare earth element with a specific surface area of 30 $m^2/g$ or more as determined by a BET single-point method, wherein the material has a volume of pores with a pore size of 3 to 20 nm of 0.08 $cm^3/g$ or more as determined by a gas absorption method.

2. The material for cold spraying according to claim 1, wherein the powder has a crystallite diameter of 25 nm or less.

3. The material for cold spraying according to claim 1, having a repose angle of from 10 to 60°.

4. The material for cold spraying according to claim 1, having, in an L*a*b* color system, a value L of 85 or more, a value a of from −0.7 to 0.7, and a value b of from −1 to 2.5.

5. The material for cold spraying according to claim 1, wherein the compound of the rare earth element is at least one selected from the group consisting of a rare earth element oxide, a rare earth element fluoride, and a rare earth element oxyfluoride.

6. The material for cold spraying according to claim 1, wherein the rare earth element is yttrium.

7. The material for cold spraying according to claim 1, wherein, in X-ray diffractometry on the material using Cu-Kα rays or Cu-$K\alpha_1$ rays, a maximum peak exhibited at 2θ=10 to 90° is assigned to $YF_3$, $Y_2O_3$, YOF or $Y_5O_4F_7$.

8. The material for cold spraying according to claim 1, wherein the material has the volume of pores with the pore size of 20 nm or less of 0.03 $cm^3/g$ or more as determined by a mercury intrusion porosimetry.

9. A method for producing a coating by a cold spraying method, wherein the coating contains the material according to claim 1.

10. A method for producing the material for cold spraying according to claim 1, the compound of a rare earth element being a rare earth element oxide, the method comprising:

dissolving a powder of a rare earth element oxide in a warmed weakly acidic aqueous solution and then cooling down the resulting solution to thereby allow a weak acid salt of the rare earth element to precipitate; and firing the weak acid salt at 450 to 950° C.

11. A method for producing the material for cold spraying according to claim 1, the compound of a rare earth element being a rare earth element fluoride, the method comprising:

mixing an aqueous solution of a water-soluble salt of a rare earth element with hydrofluoric acid to thereby allow a rare earth element fluoride to deposit; and drying the obtained deposit at 250° C. or less, wherein firing is not performed after the drying.

12. A method for producing the material for cold spraying according to claim 1, the compound of a rare earth element being a rare earth element oxyfluoride, the method comprising:

the first step of mixing, with hydrofluoric acid, a powder of a rare earth element oxide or a precursor that forms a rare earth element oxide when being fired, to thereby obtain a precursor of a rare earth element oxyfluoride; and the second step of firing the precursor of the rare earth element oxyfluoride.

13. The method for producing the material for cold spraying according to claim 12, further comprising: dissolving a powder of a rare earth element oxide in a warmed weakly acidic aqueous solution and then cooling down the resulting solution to thereby allow a weak acid salt of the rare earth element to precipitate; and firing the weak acid salt at 450 to 950° C. to thereby obtain a powder of a rare earth element oxide, wherein the obtained powder of a rare earth element oxide is used as the rare earth element oxide in the first step.

14. The method for producing the material for cold spraying according to claim 12, wherein, in the first step, a rare earth element carbonate is used as the precursor that forms a rare earth element oxide when being fired.

15. The method for producing the material for cold spraying according to claim 14, wherein the rare earth element carbonate is obtained by allowing a water-soluble salt of a rare earth element selected from the group consisting of a rare earth element nitrate and a rare earth element hydrochloride to react with a hydrogen carbonate selected from the group consisting of an ammonium hydrogen carbonate, a sodium hydrogen carbonate, and a potassium hydrogen carbonate.

16. A material for cold spraying, comprising a powder of a compound of a rare earth element with a specific surface area of 30 $m^2/g$ or more as determined by a BET single-point method, wherein the material has a volume of pores with a pore size of 20 nm or less of 0.03 $cm^3/g$ or more as determined by a mercury intrusion porosimetry.

17. A material for cold spraying, comprising a powder of a compound of a rare earth element with a specific surface area of 45 to 325 $m^2/g$ as determined by a BET single-point method, wherein the compound of the rare earth element is at least one selected from the group consisting of a rare earth element oxide, a rare earth element fluoride, and a rare earth element oxyfluoride, the powder has a crystallite diameter of from 3 to 25 nm, and the material has a volume of pores with a pore size of 3 to 20 nm of from 0.08 to 1.0 $cm^3/g$ as determined by a gas absorption method.

18. The material for cold spraying according to claim 17, wherein the material has a repose angle of from 20 to 50°, the material has a cumulative volume particle size at a cumulative volume of 50 vol % as determined by a laser diffraction/scattering particle size distribution measurement, $D_{50N}$, of from 1.5 to 80 μm, the material has a cumulative volume particle size at cumulative volume of 50 vol % as determined by a laser diffraction/scattering particle size distribution measurement after ultrasonication at 300 W for 15 minutes, $D_{50D}$, of from 0.3 to 30 μm, and in an L*a*b* color system, the material has a value L of 90 or more, a value a of from −0.7 to 0.7, and a value b of from −1 to 2.5.

* * * * *